US007966910B1

(12) United States Patent
Cece

(10) Patent No.: US 7,966,910 B1
(45) Date of Patent: Jun. 28, 2011

(54) RING STYLED BOTTLE OPENER

(76) Inventor: David Cece, Delray Beach, FL (US)

( * ) Notice: Subject to any disclaimer, the term of this patent is extended or adjusted under 35 U.S.C. 154(b) by 0 days.

(21) Appl. No.: 11/273,158

(22) Filed: Nov. 14, 2005

Related U.S. Application Data

(60) Provisional application No. 60/628,626, filed on Nov. 17, 2004.

(51) Int. Cl.
*B67B 7/16* (2006.01)

(52) U.S. Cl. ..... 81/3.55; 81/3.09; D8/40

(58) Field of Classification Search ..... 81/3.55, 81/3.07, 3.08, 3.09, 3.4, 3.56, 177.3; D8/33, D8/40

See application file for complete search history.

(56) References Cited

U.S. PATENT DOCUMENTS

| | | | | | |
|---|---|---|---|---|---|
| 888,580 | A * | 5/1908 | Brinn | 81/3.41 |
| 1,519,816 | A * | 12/1924 | Ward | 30/298 |
| 2,548,517 | A * | 4/1951 | Clark | 81/3.57 |
| 4,433,597 | A * | 2/1984 | Rowland | 81/3.09 |
| 4,667,544 | A * | 5/1987 | Milo | 81/3.09 |
| 4,765,208 | A * | 8/1988 | Sakosky | 81/3.55 |
| 4,979,407 | A * | 12/1990 | Hernandez et al. | 81/3.09 |
| 5,029,495 | A * | 7/1991 | Rosenberger | 81/3.09 |
| D347,152 | S * | 5/1994 | Mohawk et al. | D8/40 |
| 5,329,832 | A * | 7/1994 | Tegethoff | 81/3.55 |
| 5,347,890 | A * | 9/1994 | Rufkahr | 81/3.55 |
| D373,941 | S * | 9/1996 | Davis | D8/40 |
| D422,860 | S * | 4/2000 | Vinar | D8/40 |
| D438,075 | S * | 2/2001 | Van Meter | D8/40 |
| D454,765 | S * | 3/2002 | Jansson | D8/40 |
| 6,742,414 | B1 * | 6/2004 | Brailsford et al. | 81/3.55 |
| 6,761,088 | B1 * | 7/2004 | Sasso | 81/3.57 |
| 6,786,113 | B2 * | 9/2004 | Brailsford et al. | 81/3.55 |
| D504,635 | S * | 5/2005 | Jones | D11/26 |
| D509,456 | S * | 9/2005 | Ricci et al. | D11/26 |
| D523,711 | S * | 6/2006 | Ryan et al. | D8/34 |
| 7,143,666 | B1 * | 12/2006 | Gutierrez | 81/3.55 |
| 2005/0126344 | A1 * | 6/2005 | Jones | 81/3.55 |

* cited by examiner

*Primary Examiner* — David B Thomas
(74) *Attorney, Agent, or Firm* — Daniel S. Polley, P.A.

(57) ABSTRACT

A bottle opener in the form of a ring like member having a bottom portion defining a receiving area for receipt of a portion of a bottle cap attached to a bottle. The opener is placed on the user's finger, causing a top surface of the bottle cap receiving area to be formed by a palm side surface of the user's finger. A portion of the bottle cap is placed within the receiving area such that the top of bottle cap is abutting the user's finger and a bottom edge of the inserted bottle cap is abutting a bottom surface of the receiving area. The user, through movement of his or her hand, then proceeds to pull and/or lift off the bottle cap. The opener attaches to the bottle cap at a single location.

20 Claims, 3 Drawing Sheets

RING STYLED BOTTLE OPENER

This application claims priority to and the benefit of U.S. Application No. 60/628,626, file Nov. 17, 2004, which is incorporated by reference.

1. FIELD OF THE INVENTION

The present invention relates generally to bottle openers and in particular to a bottle cap remover, which is attached to a user's finger.

2. BACKGROUND OF THE INVENTION

Devices for removing a bottle cap from its attachment to a bottle are well known in the art. These devices work by providing an attachment point at the bottom edge of the bottle cap and a second point at the top of the bottle cap. Upon force by the user, this dual connection point causes the cap to be removed form the bottle. Certain prior bottle cap removers have been attached to ring like members. However, the bottle cap removal portion of the device again requires two attachment points and requires that the top of the cap be bent in order to be removed from its attachment to the bottle. Additionally, these prior devices when worn by user protrude significantly outward from the palm of the user's hand. Thus, an individual, such as bartender, will find the prior designs impractical to wear while working in view of the protruding bottle cap remover getting in the way of typical operations such as reaching into a cash register drawer, the bartender's pocket for a lighter, pen, etc., as well as interfering with the bartender's ability to grab other items. Thus, what is need in the art is a bottle cap remover which provides a simple and easy mechanism to quickly remove a bottle cap, while also allowing the user to continuously wear the bottle cap remover without such remover getting in the way of the typical operations of the user. It is therefore to these goals and shortcomings of the prior art to which the present invention is directed.

3. SUMMARY OF THE INVENTION

The present invention generally provides a bottle opener in the form of a ring like member having a bottom portion defining a receiving area for receipt of a portion of a bottle cap attached to a bottle. In use, the user places the opener on his or her finger, with a top surface for the bottle cap receiving area being formed by a palm side surface of the user's finger. A portion of the bottle cap is placed within the receiving area such that the top of bottle cap is abutting the user's finger and a bottom edge of the inserted bottle cap is abutting a bottom surface of the receiving area. The user, through movement of his or her hand, then proceeds to pull and/or lift off the bottle cap.

A top portion of the ring-like member can be provided with upwardly protruding first and second ends such that when the user uses the opener to remove the bottle cap, the first and/or second ends do not dig into the user's finger when pulling and/or lifting. Space can also be provided on a non-cap removal portion of the opener/remover for display of designs, indicia, artwork, logos, messages, sponsorship opportunities, endorsements, etc.

The present invention bottle opener attaches or abuts to the bottle cap only at a single location (the bottom surface of the receiving area with the bottom edge of the bottle cap), as opposed to all other known bottle openers which attach at the bottom edge of a bottle cap as well as the top surface of the bottle cap, using a bend-like motion to pry the bottle cap off.

It is therefore an object of the present invention to provide an improved bottle cap remover which attaches to the bottle cap at a single location.

It is a another object of the present invention to provide a bottle cap remover which removes bottle caps with less discomfort as compared to other known bottle removers.

It is still another object of the present invention to provide a bottle cap remover that can be worn by the use without interfering with other activities of the user.

It is even still another object of the present to provide a bottle cap remover that can also be provided with space to display indicia and/or artwork.

4. DRAWINGS

FIGS. 1*a* and 1*b* are side and side sectional views, respectively, of the present invention;

Figures 1A, 1B:
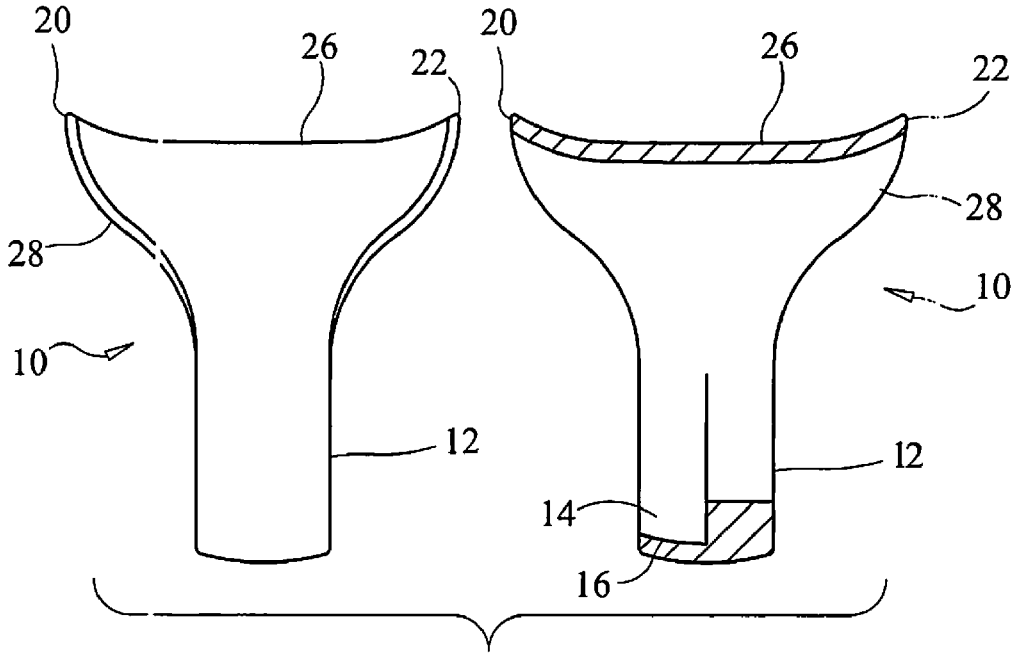
Figures 4A, 4B:
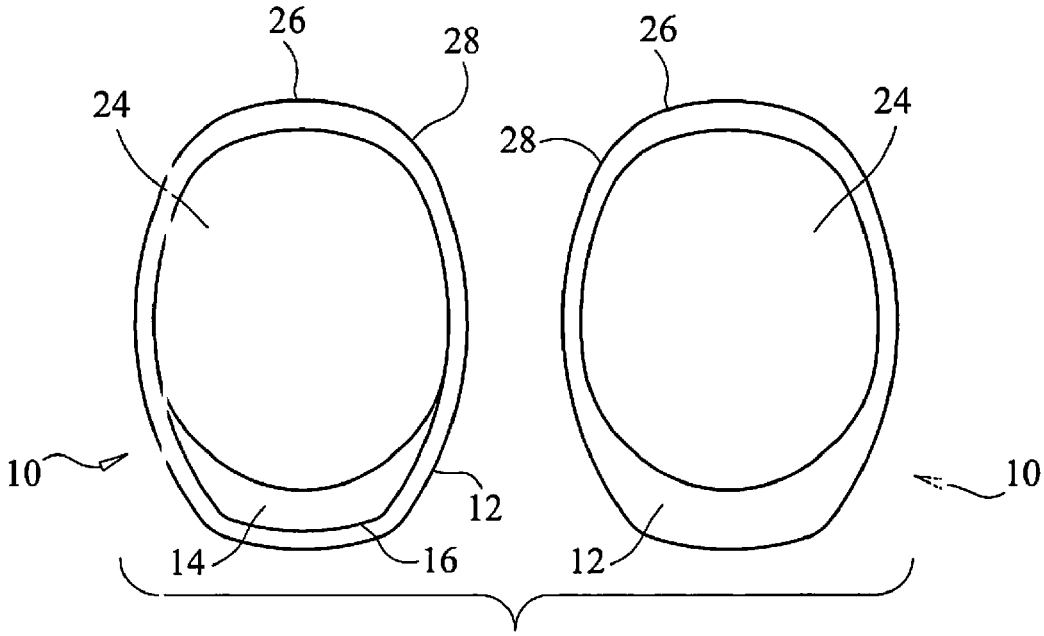
FIGS. 4*a* and 4*b* are front and back views, respectively, of the present invention.
Figure 2:
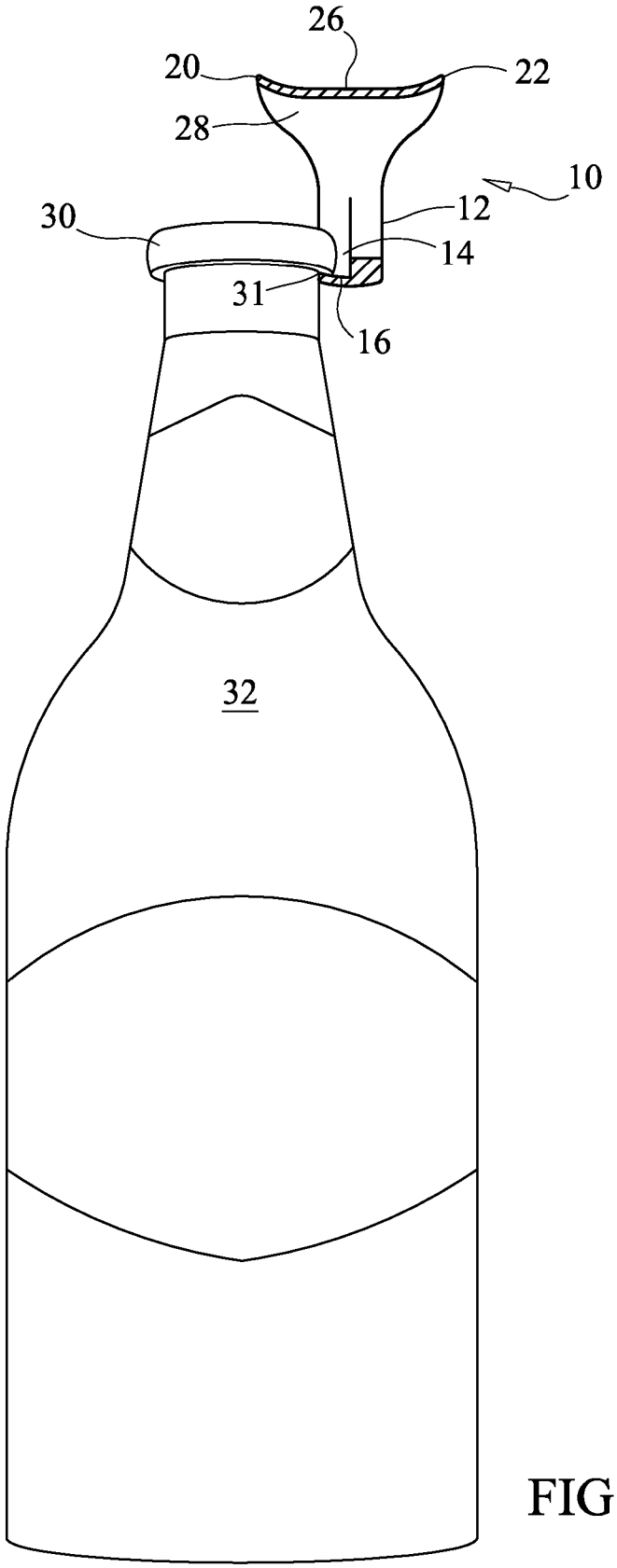
FIG. 2 is front view showing a bottle cap, still attached to a bottle, and having a sufficient portion of the cap disposed within the receiving area of the present to prevent the bottle cap to be removed by the present invention, when the present invention is worn on the user's finger.
Figure 3:
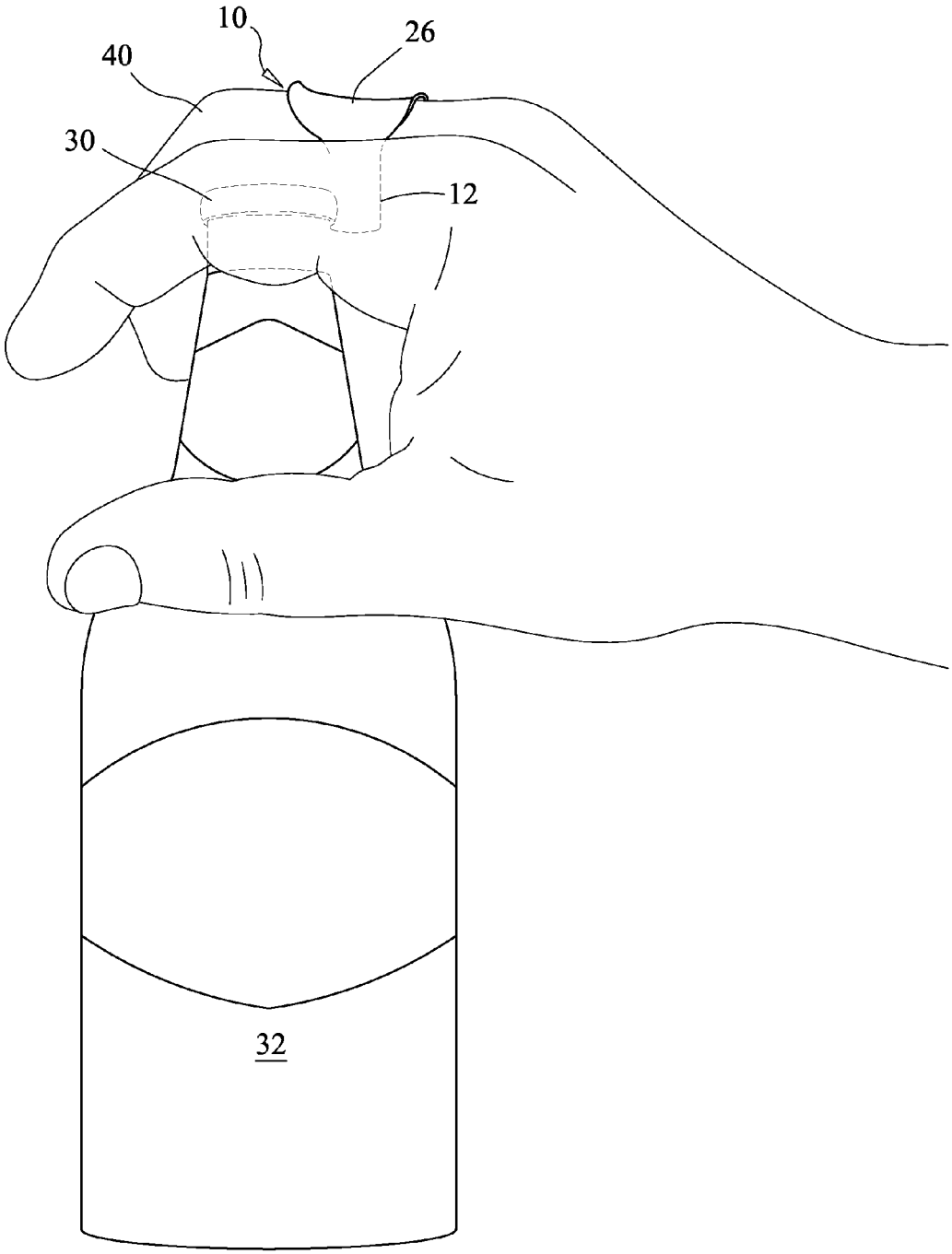
FIG. 3 is a front view showing the present invention attached to the user's finger ready to remove a bottle cap attached to a bottle.

The enclosed figures illustrate a preferred embodiment of the invention.

5. DESCRIPTION OF THE INVENTION

As seen in the drawings, the present invention provides a bottle opener in the form of a ring like member 10 with a bottom portion 12 of ring-like member 10 defining a receiving area 14 for receipt of a portion of a bottle cap 30 attached to a bottle 32. No damage to the bottle occurs from use of the present invention. Ring-like member 10 can actually be a piece of jewelry.

In use, the user places opener 10 on his or her finger 40 with a top surface for bottle cap receiving area 14 being formed by a palm side surface of the user's finger 40. Preferably, the middle finger is used. However, the present invention is not limited to any particular finger or thumb and all are considered within the scope of the invention. Thus, receiving area 14 can be located on the palm side of the user's hand with the user's finger 40 defining the top surface of receiving area 14, such as a natural wedge. A portion of bottle cap 30 is placed within receiving area 14 such that the top of bottle cap 30 is abutting the user's finger 40, and a bottom edge 31 of the inserted portion of bottle cap 30 is abutting a bottom surface 16 of receiving area 14. The user, through movement of his or her hand, then proceeds to pull and/or lift off bottle cap 30. While pulling and/or lifting, the user can pull attached bottle 32 with his or her other hand in the opposite direction to provide an easier removal of bottle cap 30, which may also reduce the wear and tear on the user's wrist.

A top portion of ring-like member 10 can be provided with upwardly protruding first and second ends, 20 and 22, respectively, such that when the user uses the opener to remove bottle cap 30, first and/or second ends 20 and 22, respectively, do not dig into the user's finger 40, when pulling and/or lifting. Thus, ends 20 and 22 of the bottle cap remover 10 can be upwardly turned so that significantly less discomfort is felt by the user during the bottle cap removal operation. As also seen in the drawings, the shape of a finger insertion opening 24 of ring-like member 10 can be somewhat flared for an easier fit and less discomfort during operation.

Space 26 can also be provided on a non-cap removal portion 28 of opener/remover 10 for display of designs, indicia, artwork, logos, messages, sponsorship opportunities, endorsements, etc.

Accordingly, the present invention attaches or abuts to bottle cap 30 only at a single location (bottom surface 16 of receiving area 14 with bottom edge 31 of bottle cap 30), as opposed to all other known bottle openers which attach at the bottom edge of a bottle cap as well as the top surface of the bottle cap, using a bend-like motion to pry the bottle cap off.

The instant invention has been shown and described herein in what is considered to be the most practical and preferred embodiment. While the invention has been described and disclosed in certain terms and has disclosed certain embodiments or modifications, persons skilled in the art, who have acquainted themselves with the invention, will appreciate that it is not necessarily limited by such terms, nor to the specific embodiments and modifications disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. A bottle opener for removing a bottle cap secured to a top edge of a bottle, said bottle cap having a top surface and a perimeter wall extending downward from said top surface with said perimeter wall having an external edge at an opposite end of said perimeter wall from said top surface, said bottle opener comprising:

a ring shaped body member having a lower portion a top portion, front edge and rear edge, said lower portion having a side cutout beginning at the front edge and extending inward therefrom but not reaching the rear edge;

wherein said side cutout defining a bottle cap portion receiving area within the lower portion of said body member, said cutout having a bottom surface, a first side wall extending upward from said bottom surface and extending inward from the front edge of the body member, a second side wall extending upward from said bottom surface and extending inward from the front edge of the body member, and a rear wall extending upward from said bottom surface such that the cutout is surrounded on three sides;

said body member defining an opening for receipt of a human finger above said cutout;

wherein placement of said body member on the human finger provides a top surface for the bottle cap portion receiving area;

wherein in use the body member is placed on the human finger and the bottle cap portion is disposed within the cutout with a top portion of the bottle cap abutting the human finger and a bottom edge portion of the bottle cap contacting the bottom surface of the cutout such that during removal of the bottle cap only the lower portion of the body member is in contact with the portion of the bottle cap.

2. The bottle opener of claim 1 wherein said top portion of said body member having a first upwardly flanged outer end and a second upwardly flanged outer end and an intermediate portion between said first flanged outer end and said second flanged outer end.

3. The bottle opener of claim 2 further comprising indicia or artwork disposed on the intermediate portion of the top end of said ring like shaped body member.

4. The bottle opener of claim 2 wherein said first upwardly flanged outer end and said upwardly second flanged outer end are monolithically formed with said ring like shaped body member to form a one-piece bottle opener.

5. The bottle opener of claim 2 wherein said first upwardly flanged outer end of said top portion is substantially similar in shape to the second upwardly flanged outer end of said top portion, said first upwardly flanged outer end extending in a direction opposite to a direction said second upwardly flanged outer end extends.

6. The bottle opener of claim 1 wherein said bottom surface of said cutout is positioned substantially parallel to said top portion and said rear wall is positioned substantially perpendicular to and upward from said bottom surface of said cutout.

7. The bottle opener of claim 6 wherein only the bottom surface of the portion of the body member comes into contact with the bottle cap when removing the bottle cap from the bottle.

8. The bottle opener of claim 1 wherein said opening in communication with said cutout and a top edge of said rear wall is curved in shape.

9. The bottle opener of claim 1 wherein said first side wall having a first end at the front edge of said body member and a second end at said rear wall and said second side wall having a first end at the front edge of said body member and a second end at said rear wall; wherein said rear wall having a first end at said first side wall and a second end at said second side wall.

10. A bottle opener for removing a bottle cap secured to a top edge of a bottle, said bottle cap having a top surface and a perimeter wall extending downward from said top surface with said perimeter wall having an external edge at an opposite end of said perimeter wall from said top surface, said bottle opener, comprising:

a ring shaped body member having a lower portion and a top portion, said lower portion having a side cutout beginning at a front end of said body member and extending inward therefrom but not reaching a rear end of said body member, said cutout for receipt of a portion of a bottle cap;

wherein said side cutout defining a bottle cap portion receiving area within the lower portion of said body member, said cutout having a bottom surface, a first side wall extending upward from said bottom surface and extending inward from the front end of said body member, a second side wall extending upward from said bottom surface and extending inward from the front end of said body member, and a rear wall extending upward from said bottom surface such that the cutout is surrounded on three sides;

wherein a top edge of said rear wall is curved in shape;

said body member defining an opening for receipt of a human finger, said opening in communication with said cutout, said top portion having a first upwardly flanged outer end and a second upwardly flanged outer end and an intermediate portion between said first flanged side and said second flanged side;

wherein placement of said body member on the human finger provides a top surface for said a bottle cap portion receiving area;

wherein in use the body member is placed on the human finger and the bottle cap portion is disposed within the cutout with a majority of a top surface of the bottle cap abutting the human finger and only a bottom edge portion of the bottle cap in contact with the body member at the bottom surface of said cutout when removing the bottle cap from its securement to the bottle.

11. The bottle opener of claim 10 further comprising indicia or artwork disposed on the intermediate portion of the top end of said ring like shaped body member.

12. The bottle opener of claim 10 wherein said first flanged outer end and said second flanged outer end are monolithically formed with said ring like shaped body member to form a one-piece bottle opener.

13. The bottle opener of claim 10 wherein said bottom surface of said cutout is positioned substantially parallel to said top portion and said rear wall is positioned substantially perpendicular to and upward from said bottom surface of said cutout.

14. The bottle opener of claim 10 wherein said first upwardly flanged outer end of said top portion is substantially similar in shape to the second upwardly flanged outer end of said top portion, said first upwardly flanged outer end extending in a direction opposite to a direction said second upwardly flanged outer end extends.

15. The bottle opener of claim 10 wherein said first side wall having a first end at the front end of said body member and a second end at said rear wall and said second side wall having a first end at the front end of said body member and a second end at said rear wall; wherein said rear wall having a first end at said first side wall and a second end at said second side wall.

16. A bottle opener for removing a bottle cap secured to a top edge of a bottle, said bottle cap having a top surface and a perimeter wall extending downward from said top surface with said perimeter wall having an external edge at an opposite end of said perimeter wall from said top surface, said bottle opener, comprising:

a ring shaped body member having a lower portion and a top portion, said lower portion having a side cutout beginning at a front end of said body member and extending inward therefrom but not reaching a rear end of said body member, said cutout for receipt of a portion of a bottle cap;

wherein said side cutout defining a bottle cap portion receiving area within the lower portion of said body member, said cutout having a bottom surface, a first side wall extending upward from said bottom surface and extending inward from the front end of said body member, a second side wall extending upward from said bottom surface and extending inward from the front end of said body member, and a rear wall extending upward from said bottom surface such that the cutout is surrounded on three sides, said first side wall having a first end at the front end of said body member and a second end at said rear wall and said second side wall having a first end at the front end of said body member and a second end at said rear wall; wherein said rear wall having a first end at said first side wall and a second end at said second side wall;

wherein a top edge of said rear wall is curved in shape;

said body member defining an opening for receipt of a human finger, said opening in communication with said cutout, said top portion having a first flanged outer end and a second flanged outer end and an intermediate portion between said first flanged outer end and said second flanged outer end, said first flanged side having an upwardly shaped outer end and said second flanged side having an upwardly shaped outer end;

wherein placement of said body member on the human finger provides a top surface for the bottle cap portion receiving area;

wherein in use the body member is placed on the human finger and the bottle cap portion is disposed within the cutout with a top portion of the bottle cap abutting the human finger and only a bottom edge portion of the bottle cap in contact with the body member at the bottom surface of said cutout;

wherein said bottom surface positioned substantially parallel to said top portion and said rear wall positioned substantially perpendicular to said bottom surface.

17. The bottle opener of claim 16 further comprising indicia or artwork disposed on the intermediate portion of the top end of said ring like shaped body member.

18. The bottle opener of claim 16 wherein said first flanged outer end and said second flanged outer end are monolithically formed with said ring like shaped body member to form a one-piece bottle opener.

19. The bottle opener of claim 16 wherein only the lower surface of the bottom portion comes into contact with the bottle cap when removing the bottle cap from the bottle.

20. The bottle opener of claim 16 wherein said first upwardly flanged outer end of said top portion is substantially similar in shape to the second upwardly flanged outer end of said top portion, said first upwardly flanged outer end extending in a direction opposite to a direction said second upwardly flanged outer end extends.

* * * * *